US011491610B2

(12) United States Patent
Shibata et al.

(10) Patent No.: US 11,491,610 B2
(45) Date of Patent: Nov. 8, 2022

(54) WAFER GRINDING METHOD

(71) Applicants: DENSO CORPORATION, Kariya (JP); DISCO CORPORATION, Tokyo (JP)

(72) Inventors: Hiroshi Shibata, Tokyo (JP); Souichi Matsubara, Tokyo (JP); Jun Koide, Tokyo (JP)

(73) Assignees: DISCO CORPORATION, Tokyo (JP); DENSO CORPORATION, Aichi (JP)

( * ) Notice: Subject to any disclaimer, the term of this patent is extended or adjusted under 35 U.S.C. 154(b) by 854 days.

(21) Appl. No.: 16/359,059

(22) Filed: Mar. 20, 2019

(65) Prior Publication Data

US 2019/0291240 A1 Sep. 26, 2019

(30) Foreign Application Priority Data

Mar. 22, 2018 (JP) ..... JP2018-054236

(51) Int. Cl.
*B24B 51/00* (2006.01)
*B24B 7/16* (2006.01)
*B24B 1/00* (2006.01)

(52) U.S. Cl.
CPC ..... *B24B 51/00* (2013.01); *B24B 1/00* (2013.01); *B24B 7/16* (2013.01)

(58) Field of Classification Search
CPC .. B24B 51/00; B24B 1/00; B24B 7/16; B24B 49/02; B24B 49/03; B24B 49/04; B24B 49/045; B24B 49/10; B24B 49/12; B24B 7/228; B24B 37/04; B24B 37/042; B24B 37/10; B24B 37/107
See application file for complete search history.

(56) References Cited

U.S. PATENT DOCUMENTS

2007/0227655 A1* 10/2007 Kajiyama ..... H01L 21/3043 438/690
2007/0231929 A1* 10/2007 Kajiyama ..... H01L 21/67132 438/6
2008/0090505 A1* 4/2008 Yoshida ..... B24B 7/228 451/413
2016/0064230 A1* 3/2016 Nishihara ..... B24B 37/042 451/41

FOREIGN PATENT DOCUMENTS

JP 2007173487 A 7/2007
JP 2009141276 A 6/2009
JP 2012146889 A 8/2012
JP 2015074042 A 4/2015

* cited by examiner

*Primary Examiner* — Joel D Crandall
(74) *Attorney, Agent, or Firm* — Greer Burns & Crain, Ltd.

(57) ABSTRACT

A wafer grinding method includes grinding a central portion of a wafer by using a plurality of abrasive members annularly arranged so as to form a circular ring, thereby forming a circular recess at the central portion of the wafer and simultaneously forming an annular projection around the circular recess, recognizing a height of a grinding unit after grinding the center by using a height recognizing unit and next storing the height recognized above, and grinding an upper surface of the annular projection to a predetermined value for a height of the annular projection previously set by a setting section as a grinding end height where the grinding of the annular projection by the grinding unit is ended.

2 Claims, 3 Drawing Sheets

WAFER GRINDING METHOD

BACKGROUND OF THE INVENTION

Field of the Invention

The present invention relates to a grinding method for grinding a wafer.

Description of the Related Art

When a wafer is ground to be reduced in thickness, the rigidity of the wafer is reduced to cause a problem such that the wafer may become hard to handle in subsequent steps. To cope with this problem, there has been proposed a grinding method using a grinding wheel having a plurality of abrasive members annularly arranged so as to form a circular ring having an outer diameter smaller than the diameter of the wafer, in which the back side of the wafer is ground at a central portion thereof by using the abrasive members to thereby form a circular recess at the central portion and simultaneously form an annular projection (reinforcing portion) around the circular recess (see Japanese Patent Laid-open No. 2007-173487 and Japanese Patent Laid-open No. 2015-74042, for example).

In removing the annular projection of the wafer ground by the above grinding method, the bottom surface of the circular recess of the wafer is held on a holding surface of a holding table in a cutting apparatus, for example, and the front side of the wafer opposite to the bottom surface of the circular recess is cut by a cutting blade along the inner circumference of the annular projection to thereby remove the annular projection (see Japanese Patent Laid-open No. 2009-141276, for example). The annular projection must be supported on a holding table during cutting of the wafer in order to prevent falling of the annular projection. Known as such a holding table is a stepped holding table having a central holding portion holding the bottom surface of the circular recess and an annular holding portion holding the end surface of the annular projection.

If the annular projection is not supported by the annular holding portion of the holding table, a difference in inclination may arise between the annular projection and the circular recess in cutting away the annular projection. As a result, cracks may be generated in the central portion of the wafer where the circular recess is formed or abnormal wearing may occur in the cutting blade. To solve such a problem, the following invention has been proposed. Before cutting away the annular projection, a measuring gauge is brought into contact with the upper surface of the annular projection to monitor the height of the upper surface of the annular projection. Then, the upper surface of the annular projection is ground as monitoring the height of the upper surface of the annular projection by using the measuring gauge such that the height of the upper surface of the annular projection becomes a preset height. The height of the upper surface of the annular projection is changed according to the depth of the circular recess, or according to the thickness of the central portion where the circular recess is formed, thereby making constant the amount of projection of the annular projection (see Japanese Patent Laid-open No. 2012-146889, for example).

SUMMARY OF THE INVENTION

In the invention described in Japanese Patent Laid-open No. 2012-146889, a measuring gauge for measuring the height of the upper surface of the annular projection must be provided separately from a measuring gauge for measuring the height of the bottom surface of the circular recess. Alternatively, it is necessary to provide gauge moving means horizontally moving the measuring gauge for measuring the height of the bottom surface of the circular recess. In any case, the configuration of the grinding apparatus becomes complicated and the height of the annular projection cannot be accurately adjusted.

It is therefore an object of the present invention to provide a wafer grinding method which can eliminate the need for measurement of the height of the upper surface of the annular projection and can grind the upper surface of the annular projection such that the height of the annular projection becomes a preset height.

In accordance with an aspect of the present invention, there is provided a wafer grinding method using a grinding apparatus including a holding table having a holding surface for holding a wafer, grinding means including a rotatable grinding wheel having a plurality of abrasive members annularly arranged so as to form a circular ring having an outer diameter less than a diameter of the wafer, the abrasive members being adapted to grind a central portion of the wafer held on the holding table to thereby form a circular recess at the central portion of the wafer and also form an annular projection around the circular recess, vertical moving means vertically moving the grinding means in a direction perpendicular to the holding surface, height recognizing means recognizing a height of the grinding means moved by the vertical moving means, horizontal moving means relatively moving the holding table and the grinding means in a horizontal direction parallel to the holding surface, and a setting section setting a predetermined value for a height of the annular projection of the wafer. After the circular recess is formed, an upper surface of the annular projection is ground by the abrasive members of the grinding means to thereby adjust the height of the annular projection to the predetermined value set by the setting section. The wafer grinding method includes a center grinding step of grinding the central portion of the wafer by using the abrasive members to thereby form the circular recess and simultaneously form the annular projection around the circular recess, a height storing step of recognizing the height of the grinding means after performing the center grinding step by using the height recognizing means and next storing the height recognized above, and an annular projection grinding step of grinding the upper surface of the annular projection by using the abrasive members in a condition that a height raised from the height of the grinding means stored in the height storing step by the predetermined value previously set by the setting section is calculated as a grinding end height where the grinding of the annular projection by the grinding means is ended.

Preferably, the grinding apparatus further includes wafer height measuring means measuring a height of an upper surface of the wafer held on the holding table. Preferably, the wafer grinding method further includes a depth calculating step of calculating a depth of the circular recess from a difference between the height of the upper surface of the wafer measured by the wafer height measuring means before performing the center grinding step and a height of a bottom surface of the circular recess measured by the wafer height measuring means after finishing the center grinding step, and an annular projection grinding start height calculating step of calculating a height raised from the height of the grinding means stored in the height storing step by the depth of the circular recess calculated in the depth calculating step as a grinding start height where the grinding of the annular projection by the grinding means is started, both the depth calculating step and the annular projection grinding start height calculating step being performed before starting the annular projection grinding step.

According to the present invention, it is unnecessary to measure the height of the annular projection by bringing a measuring gauge into contact with the upper surface of the annular projection. That is, the annular projection can be ground by the abrasive members to thereby adjust the height of the annular projection to the predetermined value set by the setting section without using a measuring gauge to monitor the height of the annular projection. Accordingly, any mechanism is not required to be added to the conventional grinding apparatus in performing the present invention, so that the height of the annular projection can be easily adjusted according to the present invention.

Further, in the case that the depth calculating step of calculating the depth of the circular recess is performed after finishing the center grinding step and that the annular projection grinding start height calculating step of calculating the grinding start height of the grinding means where the grinding of the annular projection by the grinding means is started is performed before starting the annular projection grinding step, the height of the annular projection can be adjusted with high accuracy to the predetermined value set by the setting section.

The above and other objects, features, and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

[Grinding Apparatus]

Figure 1:
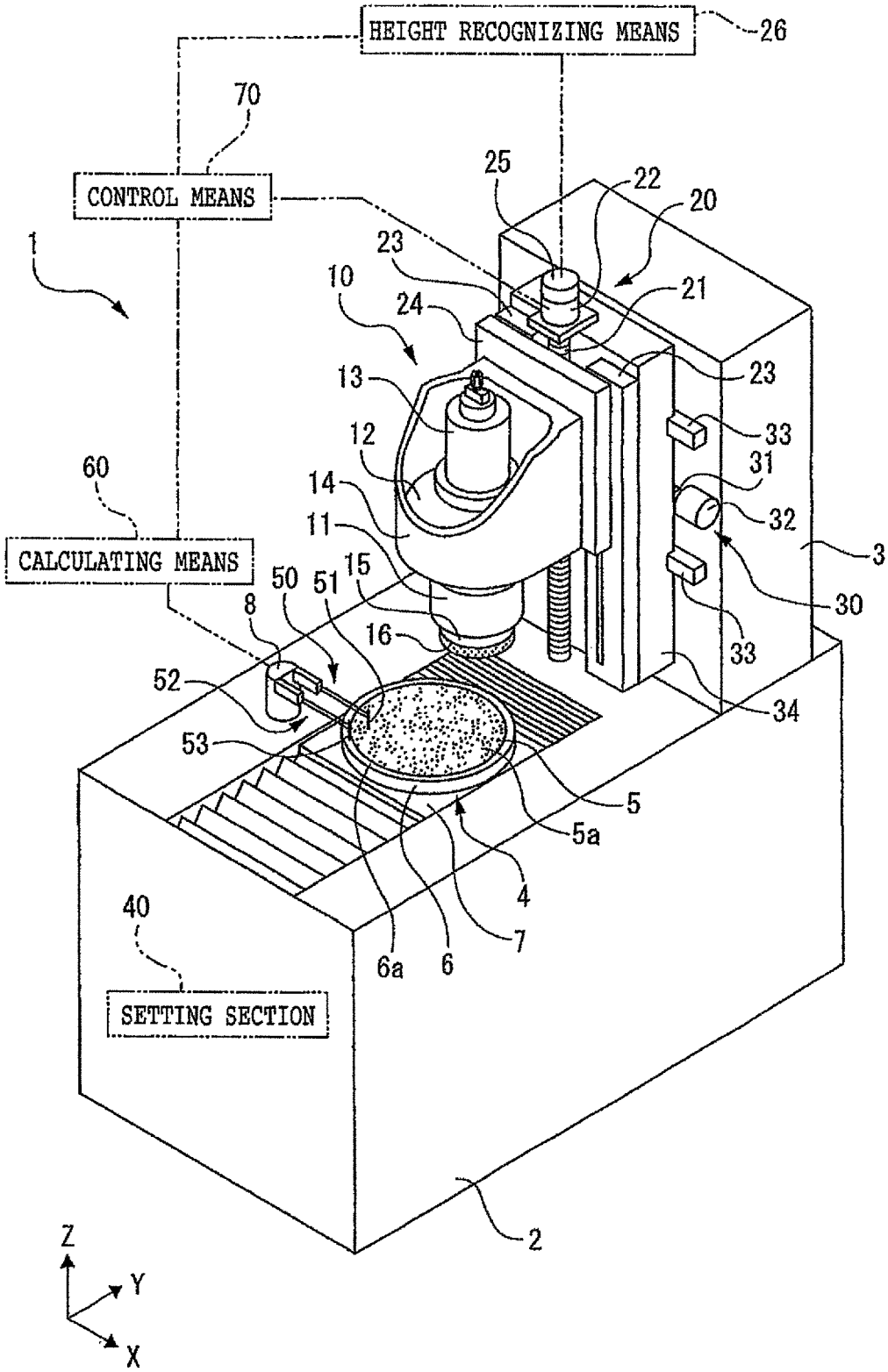
FIG. 1 is a perspective view of a grinding apparatus according to a preferred embodiment of the present invention.

Referring to FIG. 1, there is illustrated a grinding apparatus 1 according to a preferred embodiment of the present invention. The grinding apparatus 1 includes a base housing 2 extending in the Y direction indicated by an arrow Y in FIG. 1 and a column 3 standing from the upper surface of the base housing 2 at its rear end portion (one end in the Y direction). The grinding apparatus 1 further includes a holding table 4 having a holding surface 5*a* for holding a wafer (not illustrated in FIG. 1), grinding means 10 including a rotatable grinding wheel 15 having a plurality of abrasive members 16 annularly arranged so as to form a circular ring having an outer diameter less than the diameter of the wafer, the abrasive members 16 being adapted to grind a central portion of the wafer held on the holding table 4 to thereby form a circular recess at the central portion of the wafer and also form an annular projection around the circular recess, vertical moving means 20 vertically moving the grinding means 10 in a direction perpendicular to the holding surface 5*a* (in the Z direction indicated by an arrow Z in FIG. 1), height recognizing means 26 recognizing the height of the grinding means 10 moved by the vertical moving means 20, horizontal moving means 30 relatively moving the holding table 4 and the grinding means 10 in a horizontal direction parallel to the holding surface 5*a* (in the X direction indicated by an arrow X in FIG. 1), and a setting section 40 setting a predetermined value for the height of the annular projection of the wafer.

The grinding means 10 is vertically movably supported by the vertical moving means 20 on the front side of the column 3. The grinding means 10 includes a spindle 11 having an axis extending in the Z direction, a spindle housing 12 surrounding the outer circumference of the spindle 11, a motor 13 connected to one end of the spindle 11, a holder 14 for holding the spindle housing 12, the grinding wheel 15 mounted on the lower end of the spindle 11, and the plural abrasive members 16 annularly arranged on the lower surface of the grinding wheel 15. The outer diameter of the circular ring formed by the plural abrasive members 16 is set substantially equal to the radius of the wafer as a workpiece to be ground. By operating the motor 13 to rotate the spindle 11, the grinding wheel 15 can be rotated at a predetermined speed.

The vertical moving means 20 includes a ball screw 21 extending in the Z direction, a motor 22 connected to one end of the ball screw 21, a pair of guide rails 23 extending parallel to the ball screw 21, and a moving plate 24 having a nut threadedly engaged with the ball screw 21 and having a pair of sliding portions respectively adapted to slide on the pair of guide rails 23. The holder 14 is fixed to the moving plate 24. By operating the motor 22 to rotate the ball screw 21, the moving plate 24 can be vertically moved along the pair of guide rails 23, so that the grinding means 10 can be moved in the Z direction.

An encoder 25 for detecting the rotational speed of the motor 22 is connected to the motor 22. The height recognizing means 26 is connected to the encoder 25. Accordingly, the rotational speed of the motor 22 can be counted or measured by the encoder 25, and the height of the grinding means 10 in the Z direction can be recognized by the height recognizing means 26 according to a measured value output from the encoder 25. The configuration of the height recognizing means 26 is not limited to the above configuration. For example, a linear scale for position detection may be used as the height recognizing means 26.

The horizontal moving means 30 includes a ball screw 31 extending in the X direction, a motor 32 connected to one end of the ball screw 31, a pair of guide rails 33 extending parallel to the ball screw 31, and a moving plate 34 having a nut threadedly engaged with the ball screw 31 and having a pair of sliding portions respectively adapted to slide on the pair of guide rails 33. The moving plate 34 is connected to the vertical moving means 20. By operating the motor 32 to rotate the ball screw 31, the moving plate 34 can be horizontally moved along the pair of guide rails 33, so that the grinding means 10 can be moved in the X direction. Thus, the holding table 4 and the grinding means 10 can be relatively moved in the X direction.

The holding table 4 includes a porous plate 5 having the holding surface 5*a* for holding the wafer under suction and a frame 6 for storing (supporting) the porous plate 5. The frame 6 has an upper surface 6*a* flush with the holding surface 5*a*. The upper surface 6*a* of the frame 6 functions as a reference surface for the height of the holding surface 5*a*. The outer circumference of the holding table 4 is surrounded by a moving base 7. Although not illustrated, there are provided below the holding table 4 rotating means rotating the holding table 4 and moving means moving the holding table 4 with the moving base 7 in the Y direction.

The predetermined value for the height of the annular projection of the wafer to be set by the setting section 40 is equal to the difference between the height of the bottom surface of the circular recess to be formed at the central portion of the wafer by grinding the back side of the wafer and the height of the upper surface of the annular projection to be formed at the peripheral portion of the wafer after grinding the upper surface of the annular projection. For example, the setting section 40 is configured by a touch panel (not illustrated), which is adapted to be operated by an operator.

The grinding apparatus 1 further includes wafer height measuring means 50 measuring the height of the upper surface of the wafer held on the holding table 4, holding surface height measuring means 52 measuring the height of the holding surface 5*a* of the holding table 4, calculating means 60 connected to the wafer height measuring means 50 and the holding surface height measuring means 52, and control means 70 controlling at least the vertical moving means 20.

A vertically extending bracket 8 is provided on the upper surface of the base housing 2 in the vicinity of the holding table 4. Both the wafer height measuring means 50 and the holding surface height measuring means 52 are connected to an upper end portion of the bracket 8. The wafer height measuring means 50 includes a gauge head 51 located above the holding surface 5*a* of the holding table 4 and adapted to come into contact with the upper surface of the wafer held on the holding surface 5*a*. When the gauge head 51 comes into contact with the upper surface of the wafer held on the holding surface 5*a*, a measured value obtained by the wafer height measuring means 50 indicates the height of the upper surface of the wafer. Similarly, the holding surface height measuring means 52 includes a gauge head 53 located above the upper surface 6*a* of the frame 6 and adapted to come into contact with the upper surface 6*a* of the frame 6. When the gauge head 53 comes into contact with the upper surface 6*a* of the frame 6, a measured value obtained by the holding surface height measuring means 52 indicates the height of the holding surface 5*a* of the holding table 4. While both the wafer height measuring means 50 and the holding surface height measuring means 52 are configured by a contact type measuring gauge in this preferred embodiment, this configuration is merely illustrative. For example, both the wafer height measuring means 50 and the holding surface height measuring means 52 may be configured by a noncontact type optical measuring gauge.

The calculating means 60 functions to calculate the difference between the height of the upper surface of the wafer measured by the wafer height measuring means 50 before grinding the wafer and the height of the bottom surface of the circular recess of the wafer measured by the wafer height measuring means 50 after grinding the wafer, whereby the depth of the circular recess can be calculated from this difference in height between the upper surface of the wafer and the bottom surface of the circular recess. Further, the calculating means 60 also functions to calculate the difference between a measured value obtained by the wafer height measuring means 50 and a measured value obtained by the holding surface height measuring means 52, whereby the thickness of the wafer can be calculated from this difference. As a modification, a noncontact type thickness measuring gauge for calculating the thickness of the wafer may be used. In this case, measurement light having a transmission wavelength to the wafer is applied to the wafer, and an optical path difference between reflected light from the upper surface of the wafer and reflected light from the lower surface of the wafer is calculated, whereby the thickness of the wafer can be calculated by this optical path difference.

The control means 70 essentially includes a central processing unit (CPU) computing according to a control program and a storage element such as a memory. The memory in the control means 70 previously stores various data including the depth of the circular recess calculated by the calculating means 60, the height of the grinding means 10 recognized by the height recognizing means 26, and the preset height of the annular projection previously set by the setting section 40. The control means 70 can control the vertical movement of the grinding means 10 in the Z direction to be moved by the vertical moving means 20, according to the data transmitted from the setting section 40, the calculating means 60, and the height recognizing means 26.

[Wafer Grinding Method]

Figure 2:
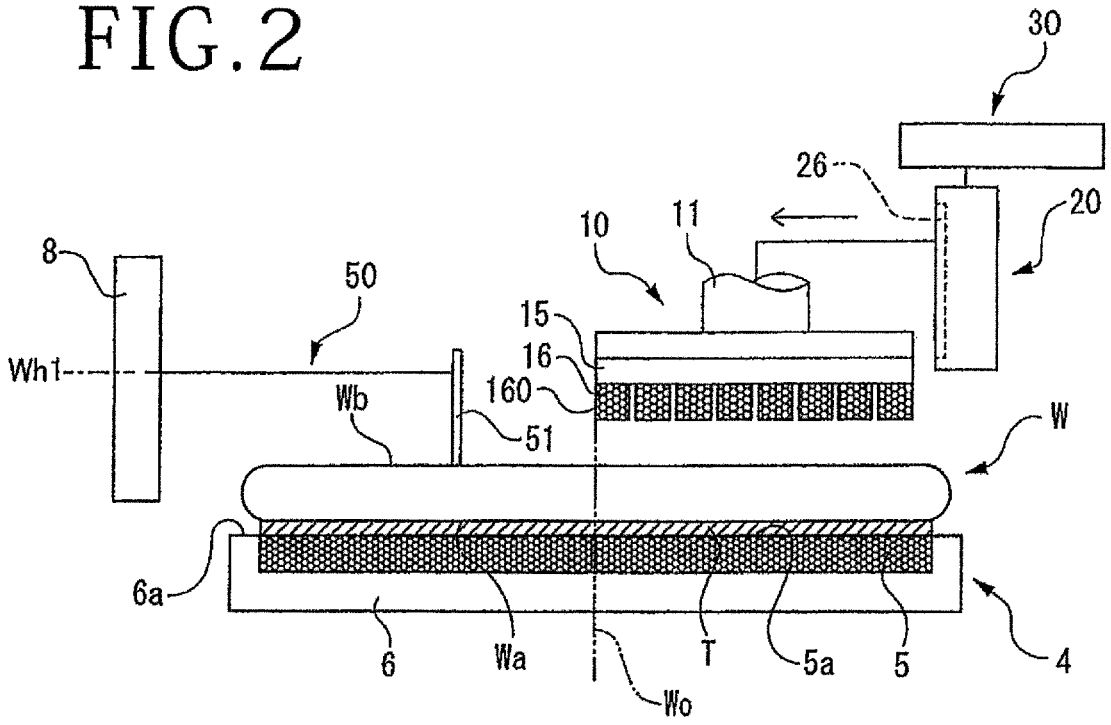
FIG. 2 is a sectional view illustrating a wafer height measuring step and a center grinding step.

There will now be described a wafer grinding method using the grinding apparatus 1 with reference to FIGS. 2 to 5. In this wafer grinding method, a central portion of a wafer W illustrated in FIG. 2 is ground to thereby form a circular recess and simultaneously form an annular projection like a circular ring surrounding the circular recess. Thereafter, the upper surface of the annular projection is ground to be adjusted in height. As illustrated in FIG. 2, the wafer W is a disk-shaped workpiece. The wafer W has a front side Wa and a back side Wb opposite to the front side Wa. A plurality of devices are previously formed on the front side Wa of the wafer W, and a protective tape T is previously attached to the front side Wa of the wafer W to thereby protect the devices. The back side Wb of the wafer W is a work surface to be ground by the abrasive members 16. Before starting the grinding of the wafer W, the operator inputs a predetermined value for the height of the annular projection into the setting section 40.

(1) Wafer Height Measuring Step

As illustrated in FIG. 2, the wafer W is placed on the holding surface 5*a* of the holding table 4 in the condition where the protective tape T attached to the front side Wa of the wafer W is in contact with the holding surface 5*a*. That is, the back side WB of the wafer W held on the holding table 4 is exposed upward. Thereafter, a vacuum source (not illustrated) is operated to apply a suction force to the holding surface 5*a*, thereby holding the wafer W on the holding surface 5*a* under suction. Thereafter, the gauge head 51 of the wafer height measuring means 50 is brought into contact with the back side Wb of the wafer W to thereby measure the height Wh1 of the upper surface of the wafer W before grinding the back side Wb. Then, the height Wh1 measured above is transmitted to the calculating means 60 illustrated in FIG. 1.

(2) Center Grinding Step

Figure 3:
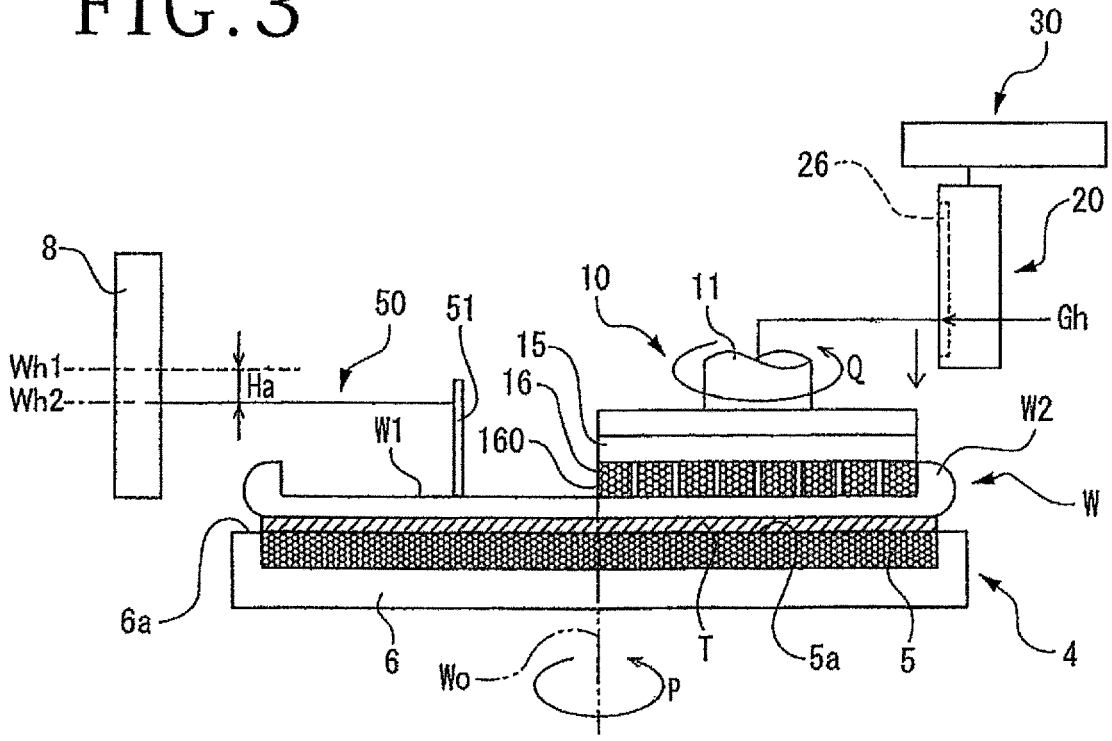
FIG. 3 is a sectional view illustrating the condition of a wafer after finishing the center grinding step and also illustrating a height storing step, a bottom surface height measuring step, and a depth calculating step.

The holding table 4 is moved to the position below the grinding means 10 in the Y direction as viewed in FIG. 1. Thereafter, the horizontal moving means 30 is operated to relatively move the grinding means 10 and the holding table 4 in the direction parallel to the holding surface 5*a* (i.e., in the X direction as viewed in FIG. 1), thereby positioning the grinding wheel 15 in such a manner that the outer circumference 160 of the circular ring formed by the plural abrasive members 16 always passes through the center Wo of rotation of the wafer W, that is, in such a manner that the center Wo of rotation of the wafer W always lies on the outer circumference 160 of the circular ring as viewed in plan. Thereafter, as illustrated in FIG. 3, the holding table 4 holding the wafer W under suction is rotated in the direction indicated by an arrow P in FIG. 3, and the grinding wheel 15 is also rotated in the direction indicated by an arrow Q in FIG. 3. Further, the vertical moving means 20 is operated to lower the grinding means 10 in the direction toward the wafer W until the abrasive members 16 being rotated come into contact with the back side Wb of the wafer W. Accordingly, the back side Wb of the wafer W at the central portion is ground by the abrasive members 16.

During the grinding of the wafer W, the outer circumference 160 of the circular ring formed by the abrasive members 16 is always kept in position so as to pass through the center Wo of rotation of the wafer W. Thus, the back side Wb of the wafer W at the central portion is ground by the grinding means 10 until the thickness of the central portion of the wafer W reaches a desired thickness. In other words, the back side Wb of the wafer W at the central portion is ground to thereby form a circular recess W1 at the central portion and simultaneously form an annular projection W2 like a circular ring surrounding the circular recess W1. At the time just after performing the center grinding step, the annular projection W2 of the wafer W is formed as a peripheral portion left around the circular recess W1 of the wafer W. In other words, the height of the annular projection W2 in this stage illustrated in FIG. 3 is equal to the thickness of the wafer W before grinding and larger than the preset height of the annular projection W2 previously set by the setting section 40.

(3) Height Storing Step

After performing the center grinding step, the height Gh of the grinding means 10 is recognized by the height recognizing means 26. The height Gh is the height of the grinding means 10 in the Z direction in the condition where the abrasive members 16 are in contact with the bottom surface of the circular recess W1 of the wafer W at the time the center grinding step is ended as illustrated in FIG. 3. After recognizing the height Gh by using the height recognizing means 26, the height Gh is stored into the memory of the control means 70 illustrated in FIG. 1.

(4) Bottom Surface Height Measuring Step

After performing the center grinding step, the height Wh2 of the bottom surface of the circular recess W1 is also measured by the wafer height measuring means 50, and the height Wh2 measured above is transmitted to the calculating means 60. For example, during the time period from the end of the wafer height measuring step to the end of the center grinding step, the contact between the gauge head 51 and the back side Wb of the wafer W is maintained to measure the height Wh2 of the bottom surface of the circular recess W1.

(5) Depth Calculating Step

The calculating means 60 illustrated in FIG. 1 calculates the difference between the height Wh1 measured by the wafer height measuring means 50 before performing the center grinding step and the height Wh2 measured by the wafer height measuring means 50 after performing the center grinding step. This difference is calculated as the depth Ha of the circular recess W1 as illustrated in FIG. 3. Then, this depth Ha is stored into the memory of the control means 70 illustrated in FIG. 1. While the operation of measuring the thickness of the wafer W (the thickness of the central portion where the circular recess W1 is to be formed) is not described in this preferred embodiment, the thickness of the wafer W is always monitored in actual during the center grinding step by calculating the difference between the height Wh2 of the bottom surface of the circular recess W1 measured by the wafer height measuring means 50 and the height of the holding surface 5*a* of the holding table 4 measured by the holding surface height measuring means 52.

(6) Annular Projection Grinding Start Height Calculating Step

Figure 4:
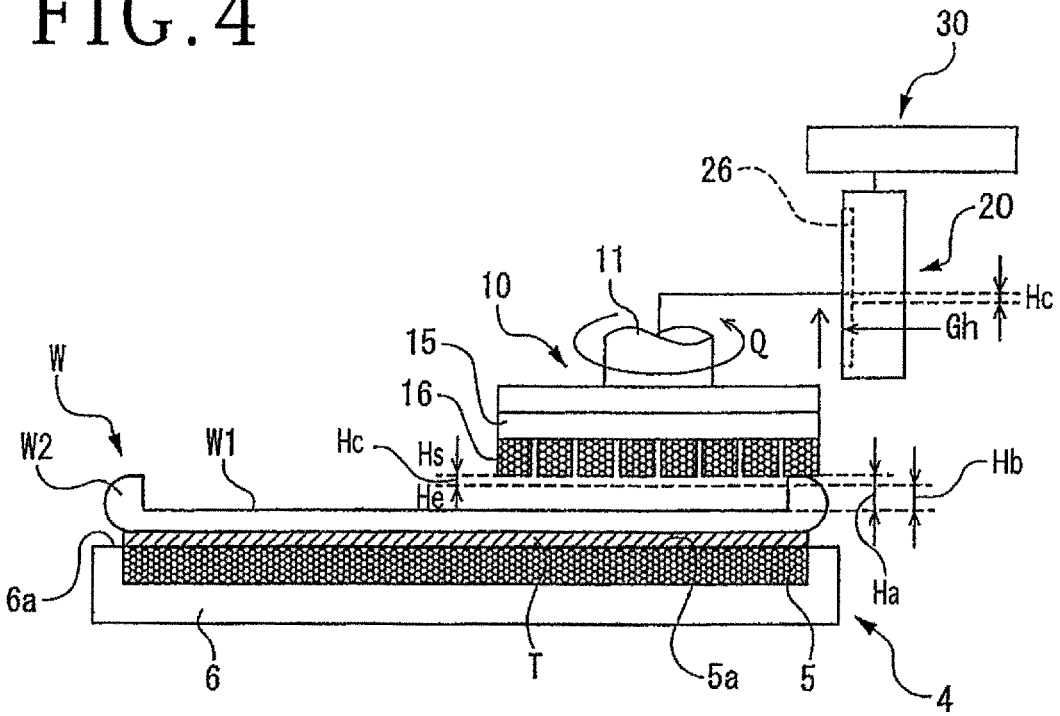
FIG. 4 is a sectional view illustrating an annular projection grinding start height calculating step.

As illustrated in FIG. 4, the grinding start height Hs for the annular projection W2 (i.e., the height of the grinding means 10 at the time the grinding of the annular projection W2 by the grinding means 10 is started) is calculated by using the depth Ha of the circular recess W1 calculated in the depth calculating step. More specifically, the grinding start height Hs where the grinding of the annular projection W2 by the grinding means 10 in the subsequent annular projection grinding step is started is calculated as the height raised from the height Gh of the grinding means 10 stored in the height storing step by the depth Ha calculated in the depth calculating step. That is, the grinding start height Hs is equal to the value obtained by adding the depth Ha to the height Gh (Gh+Ha=Hs). This calculation is performed by the control means 70 illustrated in FIG. 1. Thereafter, the control means 70 controls the vertical moving means 20 to raise the grinding means 10 by the value Hs, thereby positioning the grinding surface (lower surface) of each abrasive member 16 at the grinding start height Hs. The depth calculating step and the annular projection grinding start height calculating step may be performed before starting the subsequent annular projection grinding step.

(7) Annular Projection Grinding Step

In the annular projection grinding step, the grinding end height He for the annular projection W2 (i.e., the height of the grinding means 10 at the time the grinding of the annular projection W2 by the grinding means 10 is ended) is calculated as the height raised from the height Gh of the grinding means 10 stored in the height storing step by the preset height Hb of the annular projection W2 previously set by the setting section 40. That is, the grinding end height He is equal to the value obtained by adding the preset height Hb to the height Gh (Gh+Hb=He). This calculation is performed by the control means 70 illustrated in FIG. 1. Thereafter, the control means 70 controls the vertical moving means 20 to lower the abrasive members 16 by the amount Hc, thereby grinding the upper surface of the annular projection W2 by the amount Hc. That is, the amount Hc is equal to the difference between the grinding start height Hs and the grinding end height He. The amount Hc can be calculated by subtracting the preset height Hb from the depth Ha (Ha−Hb=Hc). This calculation is also performed by the control means 70.

Figure 5:
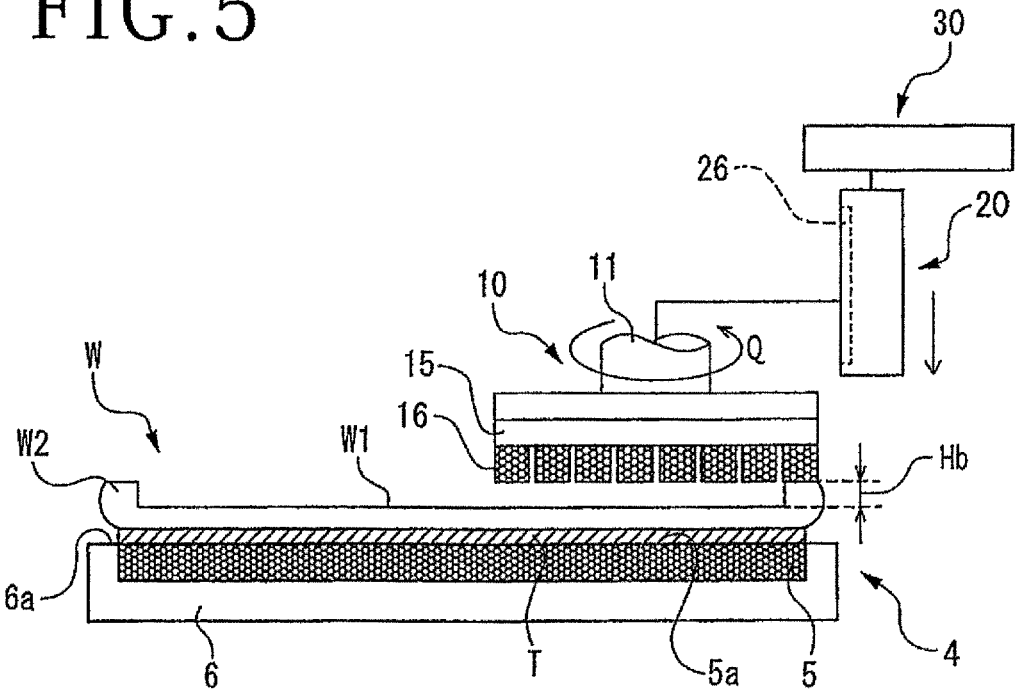
FIG. 5 is a sectional view illustrating an annular projection grinding step.

As illustrated in FIG. 5, the grinding wheel 15 is rotated in the direction indicated by an arrow Q in FIG. 5, and the vertical moving means 20 is operated to lower the grinding means 10 in the direction toward the wafer W by the amount Hc, thereby grinding the upper surface of the annular projection W2 with the abrasive members 16 by the amount Hc. Thus, the height of the annular projection W2 is adjusted to the preset height Hb. In this manner, the height of the annular projection W2 is not monitored by bringing a measuring gauge into contact with the upper surface of the annular projection W2 during the grinding of the annular projection W2, so that there is no possibility that a mechanical error or the like may be caused. The height of the annular projection W2 can be adjusted to the preset height Hb with a tolerance of ±10 μm at the maximum.

After finishing the annular projection grinding step, the wafer W is transferred to a holding table in a cutting apparatus, and the annular projection W2 of the wafer W is cut away by a cutting blade. Since the height of the annular projection W2 has been adjusted to the preset value Hb in the annular projection grinding step, it is unnecessary to interpose any height adjusting component such as a spacer between the holding table and the annular projection W2 in the cutting operation. Further, in cutting away the annular projection W2 by using the cutting blade, there is no possibility that cracks may be generated in the wafer W or abnormal wearing may occur in the cutting blade.

As described above, the wafer grinding method according to the present invention includes the height storing step of recognizing the height Gh of the grinding means 10 after finishing the center grinding step by using the height recognizing means 26 and next storing the height Gh recognized above and also includes the annular projection grinding step of grinding the upper surface of the annular projection W2 by using the abrasive members 16 in the condition that the height raised from the height Gh by the preset height Hb of the annular projection W2 previously set by the setting section 40 is calculated as the grinding end height He where the grinding of the annular projection W2 by the grinding means 10 is ended. Accordingly, it is unnecessary to measure the height of the annular projection W2 by bringing a measuring gauge into contact with the upper surface of the annular projection W2. That is, the annular projection W2 can be ground by the abrasive members 16 to thereby adjust the height of the annular projection W2 to the preset height Hb without using a measuring gauge to monitor the height of the annular projection W2. Accordingly, any mechanism is not required to be added to the conventional grinding apparatus 1 in performing the present invention, so that the height of the annular projection W2 can be easily adjusted according to the present invention.

Further, the wafer grinding method according to the present invention includes the depth calculating step of calculating the depth Ha of the circular recess W1 from the difference between the height Wh1 measured by the wafer height measuring means 50 before performing the center grinding step and the height Wh2 of the bottom surface of the circular recess W1 measured by the wafer height measuring means 50 after finishing the center grinding step and further includes the annular projection grinding start height calculating step of calculating the height raised from the height Gh of the grinding means 10 by the depth Ha as the grinding start height Hs where the grinding of the annular projection W2 by the grinding means 10 is started, both the depth calculating step and the annular projection grinding start height calculating step being performed before starting the annular projection grinding step. Accordingly, the height of the annular projection W2 can be adjusted to the preset height Hb with high accuracy.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A wafer grinding method using a grinding apparatus including:

a holding table having a holding surface for holding a wafer, grinding means including a rotatable grinding wheel having a plurality of abrasive members annularly arranged so as to form a circular ring having an outer diameter less than a diameter of the wafer, the abrasive members being adapted to grind a central portion of the wafer held on the holding table to thereby form a circular recess at the central portion of the wafer and also form an annular projection around the circular recess, vertical moving means vertically moving the grinding means in a direction perpendicular to the holding surface, height recognizing means recognizing a height of the grinding means moved by the vertical moving means, horizontal moving means relatively moving the holding table and the grinding means in a horizontal direction parallel to the holding surface, and a setting section setting a predetermined value for a height of the annular projection of the wafer, wherein after the circular recess is formed, an upper surface of the annular projection is ground by the abrasive members of the grinding means to thereby adjust the height of the annular projection to the predetermined value set by the setting section, the wafer grinding method comprising:

a center grinding step of grinding the central portion of the wafer by using the abrasive members to thereby form the circular recess and simultaneously form the annular projection around the circular recess;

a height storing step of recognizing the height of the grinding means after performing the center grinding step by using the height recognizing means and next storing the height recognized above; and an annular projection grinding step of grinding the upper surface of the annular projection by using the abrasive members in a condition that a height raised from the height of the grinding means stored in the height storing step by the predetermined value previously set by the setting section is calculated as a grinding end height where the grinding of the annular projection by the grinding means is ended.

2. The wafer grinding method according to claim 1, wherein the grinding apparatus further includes: wafer height measuring means measuring a height of an upper surface of the wafer held on the holding table, the wafer grinding method further comprising:

a depth calculating step of calculating a depth of the circular recess from a difference between the height of the upper surface of the wafer measured by the wafer height measuring means before performing the center grinding step and a height of a bottom surface of the circular recess measured by the wafer height measuring means after finishing the center grinding step; and an annular projection grinding start height calculating step of calculating a height raised from the height of the grinding means stored in the height storing step by the depth of the circular recess calculated in the depth calculating step as a grinding start height where the grinding of the annular projection by the grinding means is started;

both the depth calculating step and the annular projection grinding start height calculating step being performed before starting the annular projection grinding step.

* * * * *